United States Patent [19]

Voith et al.

[11] Patent Number: 4,643,248

[45] Date of Patent: Feb. 17, 1987

[54] PROTECTION OF HEAT EXCHANGER TUBE ENDS

[75] Inventors: Donald J. Voith, Milwaukee, Wis.; Kaveh S. Someah, San Rafael, Calif.

[73] Assignee: Water Services of America, Inc., Milwaukee, Wis.

[21] Appl. No.: 829,706

[22] Filed: Feb. 14, 1986

[51] Int. Cl.[4] ..... F28G 1/06; F28G 1/12; F28F 19/00

[52] U.S. Cl. ..... 165/95; 165/134.1; 15/3.51; 15/104.06 R

[58] Field of Search ..... 165/95, 134.1; 15/3.51, 15/104.06 R

[56] References Cited

U.S. PATENT DOCUMENTS

| | | | |
|---|---|---|---|
| 4,489,776 | 12/1984 | Baron | 165/95 |
| 4,508,164 | 4/1985 | Baron | 165/95 |
| 4,544,026 | 10/1985 | Baron | 165/95 |
| 4,561,495 | 12/1985 | Baron | 165/95 |
| 4,592,417 | 6/1986 | Baron | 165/95 |
| 4,595,049 | 6/1986 | Baron et al. | 165/95 |
| 4,595,050 | 6/1986 | Baron | 165/95 |

FOREIGN PATENT DOCUMENTS

| | | | |
|---|---|---|---|
| 2817992 | 8/1979 | Fed. Rep. of Germany | 165/95 |
| 2822623 | 8/1979 | Fed. Rep. of Germany | 165/95 |
| 2024982 | 1/1980 | United Kingdom | 165/95 |

*Primary Examiner*—William R. Cline
*Assistant Examiner*—John K. Ford
*Attorney, Agent, or Firm*—Andrus, Sceales, Starke & Sawall

[57] ABSTRACT

A heat exchanger (1) has a plurality of metallic fluid flow tubes (5) secured adjacent their ends by tube sheets (6, 7). A non-corrodible, erosion resistance, non-metallic elongated sleeve-like insert (30) is telescopingly mounted within a tube. The insert length corresponds closely with the length of the finite tube end section (21) subject to damage from fluid turbulence, which has been found to be in the range of about 5 to 12 inches depending upon the tube I.D. as well as fluid velocity and pressures. To prevent undesirable penetration of corrosive materials and gases into any void that may exist between the plastic insert and metallic heat exchanger tube, a filler (33) of adhesive epoxy or the like may be applied to fill the void. The insert (30) provides only a single element reduction in passage diameter. When a tube cleaning brush (25) and basket (26) system is also utilized, brush diameter reduction relative to the tube I.D. is minimized. The outer insert end may conveniently serve as the connection to the brush capturing plastic basket (26). In the embodiments disclosed, the insert (30) and the basket (26) are connected via cooperating thread means (36, 41) or may be connected integrally, as per FIG. 6. In both cases, the need for a tube I.D.-reducing press fit of the basket is eliminated and the basket need not be reduced in diameter relative to the heat exchanger tube. The insert and basket together form a continuous brush-receiving channel leading to the open cage portion of the basket.

7 Claims, 7 Drawing Figures

PROTECTION OF HEAT EXCHANGER TUBE ENDS

BACKGROUND AND SUMMARY OF THE INVENTION

This invention relates to protection of heat exchanger tube ends.

Heat exchangers often contain a large number of metal tubes through which heat exchanging fluid flows. The tubes are usually arrayed in parallelism and are supported adjacent their ends by transverse tube sheets. See, for example, U.S. Pat. No. 4,489,776 issued Dec. 25, 1984. The tube ends are disposed in the heat exchanger heads which form chambers for the containment and transfer of fluid from and to the tubes.

Heretofore it has been observed that, after long periods of service, the inner surfaces of the tube end portions, and especially the inlets, often tend to become heavily pitted or worn away, thus weakening the entire structure. It is believed that such undesirable effects are due to erosion, and also in some instances corrosion, of the metal pipe surface, which may extend far back into the tubes. The erosion is believed due to the existence of turbulence of the fluid for a finite distance inwardly of the tube ends, combined with the eroding action of silt or other contaminants in the fluid. The turbulence ends at a point inwardly of the tube ends so that the fluid flows in a laminar fashion throughout the remainder, and longest, portion of the tubes. In the areas of laminar fluid flow, there is substantially less turbulence or erosion. Furthermore, metals tend to corrode due to chemical action of the fluid. The combination of erosion and corrosion of the eroding tube end portions thus leads to weakened tubes.

Previous attempts have been made to protect heat exchanger tube end portions from the deleterious effects of the turbulence-caused erosion, together with corrosion, which occurs and is visually observable as a damaged tube section on the inner surface thereof for a finite distance inwardly of the tube ends. One such attempt has been to provide metallic inserts which are fit, rolled and sometimes welded into the tube ends for the purpose of preventing erosion and damage to the end portions. The inserts are of a length to cover the damaged tube sections. However, the use of such metal inserts has not solved the problem and has given rise to further problems.

The prior metal inserts are also subject to erosion and corrosion, and in effect become sacrificial elements which themselves are damaged over long periods of use. When such inserts become damaged, they need to be replaced with new inserts, but it has been found that the interfaces between the inserts and tubes have often become corroded by galvanic action so that the inserts cannot be removed without destroying the tube ends.

Yet another difficulty occurs because the metal inserts reduce the effective internal diameter (I.D.) of the tubes. In the event that it is desirable to retrofit the heat exchanger with sets of shuttleable tube cleaning elements such as brushes which are captured by cages or baskets disposed at each end of the tubes, the brushes must be made smaller than the I.D. of the tubes in order to pass through the reduced I.D. of the inserts. By itself, this difference in brush diameter might not adversely affect their cleaning ability. However, most brush capturing baskets are provided with short necks which are fit into the tube ends. When the tube ends include I.D. reducing inserts, the basket necks further reduce the effective I.D. and thus the available diameter for the brushes to pass through. Thus, the brushes must be made substantially smaller in diameter than the brushes designed for the original tube I.D. The result is that the smaller brushes do not firmly contact the walls of the tubes during brush shuttling, impairing their cleaning function. Furthermore, baskets originally designed for a given tube I.D. will have to be redesigned to handle an effective tube end of smaller diameter.

It is a task of the present invention to solve the various problems discussed above so that the finite areas of fluid turbulence adjacent the tube ends of a heat exchanger or the like are accompanied by substantially less or no erosion or corrosion, as compared to prior known systems. It is a further task to substantially eliminate the double reduction in tube I.D. of the above-described prior systems so that when a tube cleaning brush and basket system is utilized in conjunction with an insert, the brush I.D.s do not need to be reduced by an amount which adversely affects the cleaning function thereof. It is yet another task to combine the various elements to provide a brush passage of essentially a single diameter in the areas of fluid turbulence at the ends of heat exchanger tubes.

In accordance with the various aspects of the invention, a basically non-corrodible elongated sleeve-like insert is provided, with the insert also being erosion resistant. These desirable characteristics are accomplished by making the insert of non-metallic material such as sythetic rubber or plastic. The insert's outside diameter (O.D.) is closely similar to the I.D. of the heat exchanger tubes so that the insert may be inserted and removed from the tube end with relative ease. The insert length is intended to correspond closely with the length of the finite tube end section subject to damage from fluid turbulence, which has been found to be in the range of about 5 to 12 inches depending upon the tube I.D. as well as fluid velocity and pressures. If desired, and to prevent undesirable penetration of corrosive materials and gases into any void that may exist between the non-metallic insert and metallic heat exchanger tube, a filler of epoxy or the like may be applied to fill the void.

In accordance with further inventive aspects, the insert is contemplated as providing only a single element reduction in passage diameter. When a tube cleaning brush and basket system is also utilized, brush diameter reduction relative to the tube I.D. is minimized.

In connection with a tube cleaning brush and basket system, the outer insert end may conveniently serve as the connection to a brush capturing plastic basket. In the embodiments disclosed herein, the insert and basket are connected via cooperating thread means, or may be connected integrally. In both cases, the need for a tube I.D.-reducing press fit of the basket is eliminated and the basket need not be reduced in diameter relative to the heat exchanger tube. The insert and basket together form a continuous brush-receiving channel leading to the open cage portion of the basket.

BRIEF DESCRIPTION OF THE DRAWINGS

The accompanying drawings illustrate the best mode presently contemplated by the inventors for carrying out the invention.

In the drawings

DESCRIPTION OF THE PREFERRED EMBODIMENTS

Figure 1:
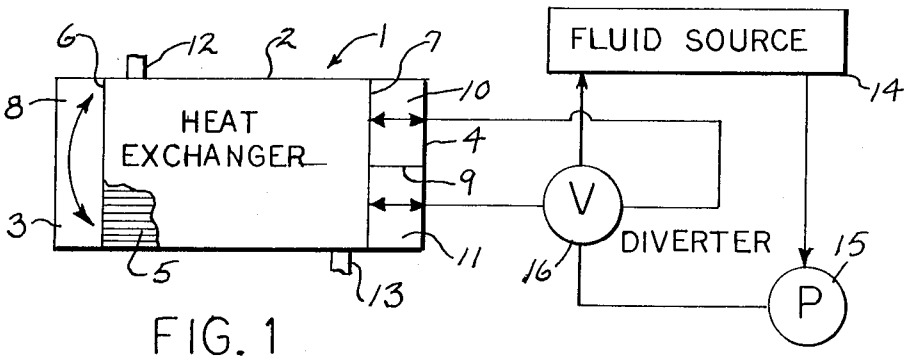
FIG. 1 is a schematic showing of a heat exchanger and fluid flow controls therefor.

The present invention is directed to the protection of the tube end portions of tube-type heat exchangers such as steam condensers or the like. A schematic showing of such an exchanger and its fluid flow controls is shown in FIG. 1. The exchanger 1 comprises a cylindrical housing 2 having end closure heads 3 and 4, and a plurality of longitudinally extending tubes 5 therein. The exposed open ends of tubes 5 are mounted to transverse tube sheets 6 and 7 which are spaced from the respective end heads 3 and 4. Head 3 and tube sheet 6 form one fluid flow chamber 8, while a partition 9 separates the space between head 4 and tube sheet 7 into a pair of fluid flow chambers 10 and 11. Heat exchanging fluid is introduced through an inlet 12 to the area around tubes 5 and discharges through an outlet 13.

Heat exchanger 1 is also connected to a fluid source 14, a pump 15, and in the present embodiment a fluid diverter valve 16 by various conduits in the conventional manner. Fluid is directed through tubes 5 via chambers 10, 8 and 11, in that order or in reverse order, depending on the position of valve 16.

FIGS. 2–7 illustrate the area adjacent left chamber 8 and left tube sheet 6, the area at the right end of heat exchanger 1 being comtemplated as substantially the same, only a mirror image thereof.

Figure 3:
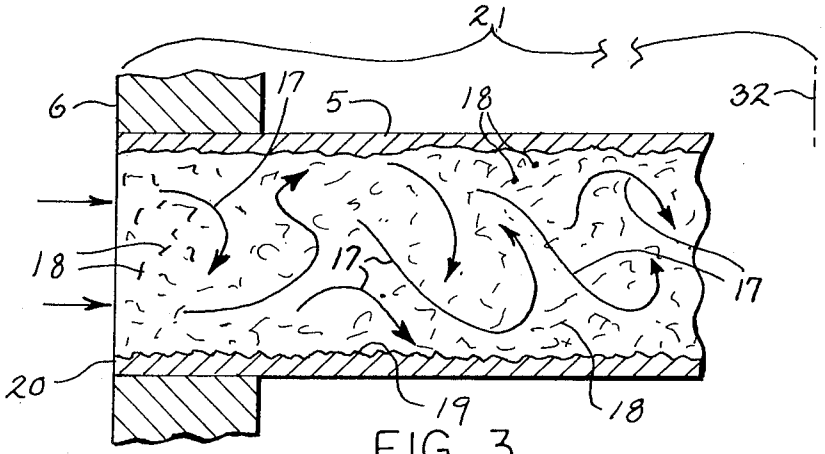
FIG. 3 is a fragmentary illustration of a tube end portion, showing the fluid turbulence and its effect on the inner tube walls.
Figure 2:
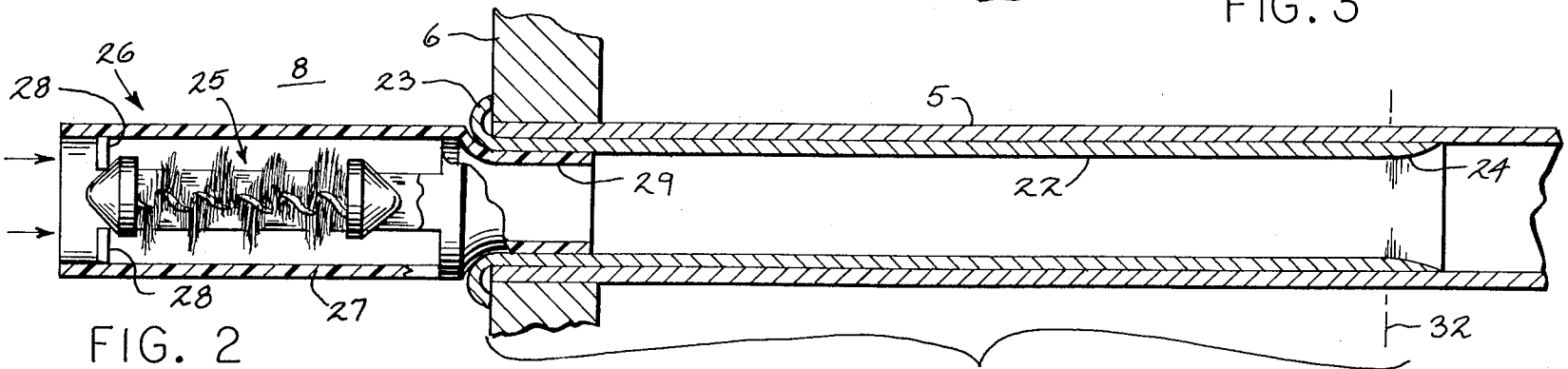
FIG. 2 PRIOR ART
FIG. 2 is an enlarged longitudinal section showing a previously known metal insert disposed in the outer tube end portion, and with the addition of a tube cleaning brush and basket system.

Turning now to FIGS. 2 and 3, and referring first to FIG. 3, as previously explained, the fluid flowing through the end portions of heat exchanger tubes 5 is subject to substantial turbulence, as illustrated by the arrows 17, although the turbulence may be greater at the inlet end portion shown than at the outlet end portion at the right end of heat exchanger 1. Silt 18 or other foreign matter contained in the turbulent fluid will gradually cause a wearing away or pitting of the inner tube wall, this erosion being illustrated at 19.

The turbulence and resultant erosion extends from the tube end terminus 20 and axially thereinto by a finite distance, illustrated by the bracket 21 with the fluid then merging into a generally non-turbulent laminar flow through the main central body of the tube. The distance of erosion extent 21 and the inner termination thereof is visually observable on a long-used tube 5, and is dependant on a number of factors including the I.D. of tube 5 as well as the velocity and pressure of the flowing fluid and the composition of the fluid. Added to the erosion is a corrosion component caused by chemical action between the fluid and metal tube wall.

FIG. 2 illustrates a prior attempt to deal with the problems of erosion and corrosion. In the disclosed prior construction, a sleeve-like metal insert 22 was slidingly telescoped into the end portion of metal tube 5. Insert 22 was elongated and of such a length as to cover damaged tube section 21, and slightly more. The outer end of insert 21 was usually peened or rolled over, as at 23, onto the outer face of tube sheet 6 to tend to hold the insert in place. Alternately, insert 21 was sometimes secured in place as by welds or expansion, not shown. The insert 22, when combined only with tube 5, was intended to function as a sacrificial erosion element which would protect the damaged tube against further erosion and corrosion, and which could itself be removed for replacement when it also became sufficiently damaged. However, several problems have occurred with this prior metallic assembly. It has been found that galvanic action caused by penetration of fluid between insert 22 and tube 5 caused corrosion at the interface therebetween, so that corrosion of tube 5 was not prevented and removal of the insert for replacement became difficult without damaging the tube.

Further problems occurred when the insert-tube assembly of FIG. 2 was used with a tube cleaning brush-basket assembly. In this instance, the inner end of insert 22 was provided with a taper 24 to assist in the passage of a tube-cleaning brush 25 of the usual well-known type. Furthermore, a plastic brush capturing basket 26 was mounted to the outer end of the assembly. Basket 26 is shown in FIG. 2 as being of a standard type including a cage 27 having brush stops 28 at its outer end, with cage 27 merging inwardly into a reduced neck 29 which in turn was fit into the outer end portion of insert 22. With this construction, a double reduction in tube wall I.D. at its outer end was created by the overlapping thicknesses of insert 22 and basket neck 29. This required that brush 25 be substantially reduced in diameter in order to pass through the confined space at the outer tube end. The result, which can be observed in FIG. 2, was that brush 25 was substantially smaller in diameter than the I.D. of tube 5 itself, so that the cleaning action of the brush as it shuttled through the main part of the tube was adversely affected.

Furthermore, basket assemblies of standard size for a tube with no insert could not be used, in view of the presence of insert 22.

The present invention solves the aforementioned problems in a simple and yet unique manner. For this purpose, and referring to FIG. 4, an erosion and corrosion resistant elongated sleeve-like insert 30 is telescopingly placed in engagement within heat exchanger tube 5. Insert 30 is made of non-metallic material such as synthetic rubber or plastic, which will not be subject to any extent to the damaging effects of turbulence and silt. Nor will it create any galvanic action with the metal of tube 5. The O.D. of insert 30 corresponds closely with the I.D. of tube 5 so that installation and removal of the insert may be accomplished easily. The length of insert 30 corresponds closely with the visually observable finite length of the occurrence of fluid turbulence and resultant erosion (21 in FIG. 2), and in this embodiment extends axially inwardly from the outer tube terminus 31 to at or slightly beyond the end 32 of the area of turbulence and the damage caused thereby. In heat exchangers of the type under consideration here, it has been found that an insert length between terminus 31 and end 32 in the range of about 5 to 12 inches will cover the desired area, and varies within that range in accordance with the I.D. of tube 5 as well as the velocity and pressure of fluid flow and other factors.

Inserts 30 may be disposed in all or only some of the tubes, the inlet tube ends perhaps being most important.

Figure 7:
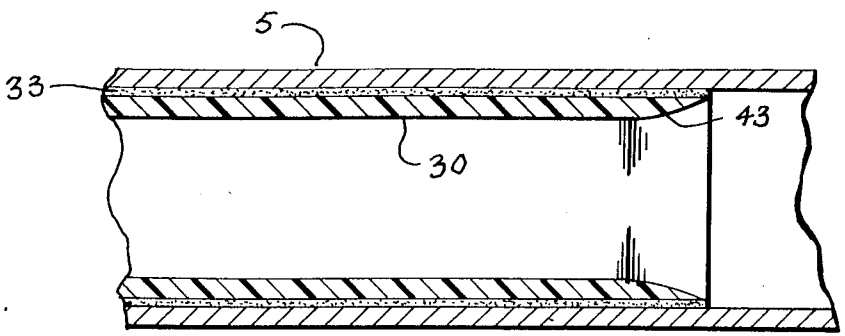
FIG. 7 is a fragmentary illustration of the use of a filler such as epoxy to fill voids between the insert and tube end portion.

If desired, and to prevent any corrosive action on tube 5 of fluid which might penetrate to between the tube and insert 30, FIG. 7 illustrates, in exaggerated thickness for purposes of clarity, the filling of any minute voids therebetween by a protective filler material 33, such as epoxy or the like which is compatible with both metal and plastic.

Figure 4:
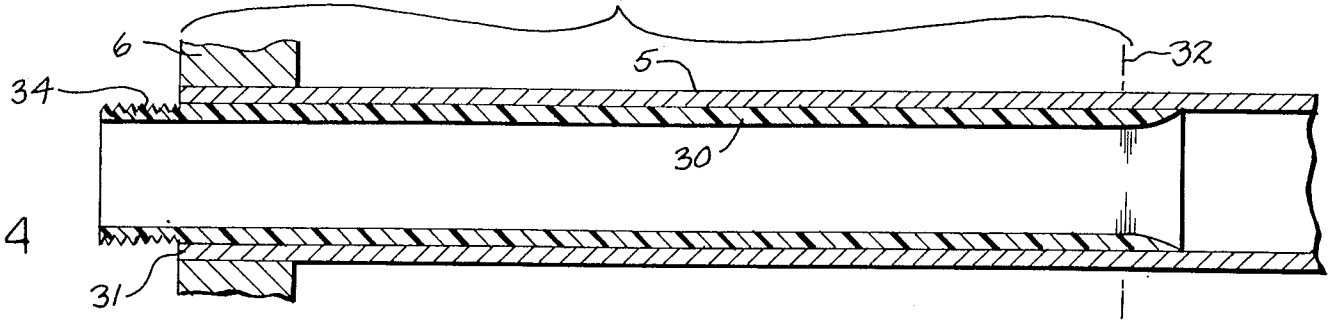
FIG. 4 is a longitudinal section illustrating the use of an elongated non-metallic insert in accordance with various aspects of the invention.

Insert 30 can be utilized by itself to protect and/or repair the outer end portion of tube 5. In FIG. 4, insert 30 extends beyond tube sheet 6 and outer tube terminus 31, and may include teeth 34 or the like to permit grasping for removal by a suitable tool, not shown In many instances it is desirable to utilize insert 30 in conjunction with a tube cleaning system including a shuttleable cleaning element, such as a brush, together with a capturing device for the element. Referring now to FIG. 5, insert 30 again extends axially outwardly beyond tube sheet 6 and tube terminus 31, as at 35, the extension this time being provided with outer threads 36 thereon. A basket 37 is connected to insert 30, and includes a cage 38 having brush stops 39 at its outer end. Cage 28 merges inwardly into an annular flange 40 of thickened wall, with flange 40 having internal threads 41 which are threadably engaged with insert threads 36 to join the basket and insert together. Basket 37 is contemplated as being made of similar non-metallic material as insert 30, and is adapted to capturingly receive a cleaning brush 42.

Figure 5:
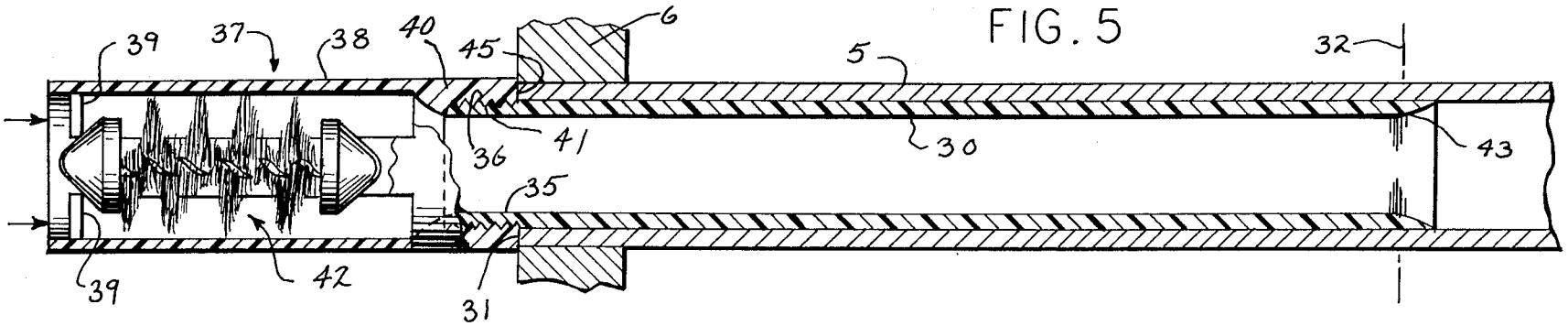
FIG. 5 is a view showing a threaded connection between a brush-capturing basket and the insert of FIG. 4.

It should be noted that with the construction of FIG. 5, only a single element reduction occurs within heat exchanger tube 5—that provided by insert 30. The guiding taper 43 is similar to guiding taper 24. A brush 42 of substantially larger diameter may be now utilized, with a resultant improvement in tube cleaning action.

Figure 6:
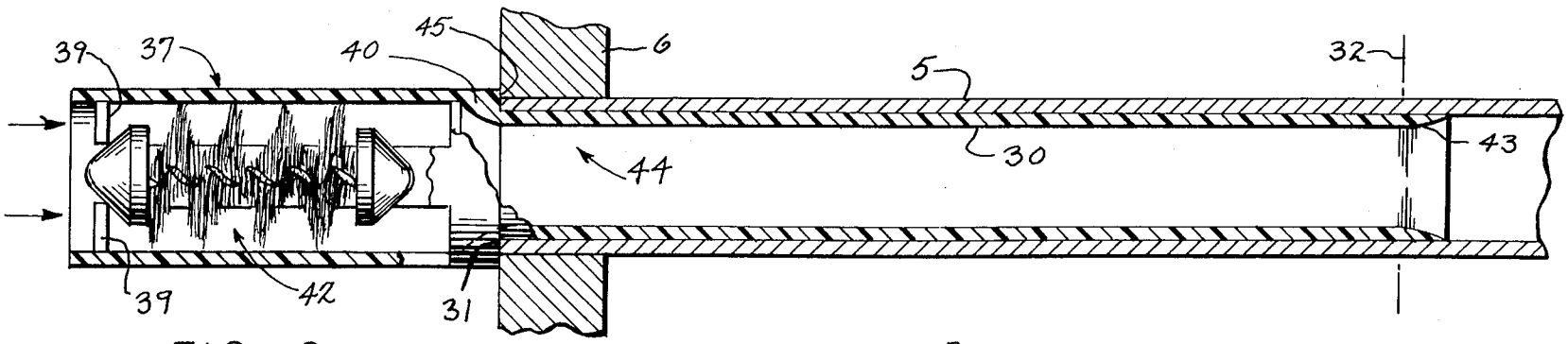
FIG. 6 is a view showing an integral connection between a brush-capturing basket and the insert.

FIG. 6 illustrates a second embodiment of connection between insert 30 and basket 37. In this instance, the threaded mounting is dispensed with and thickened annular flange 40 of basket 37 merges in a transitional manner into the end portion of insert 30 axially outwardly of tube sheet 6, so that the basket and insert form an integral assembly 44 which functions similar to and has all the advantages of the FIG. 5 construction, with the additional advantage of economy of manufacture of the member in a single die mold. Thus a single element serves to protect the interior surface of tube 5 in the area of turbulence-caused erosion (i.e. range of 5 to 12 inches), protects against corrosion, serves as a brush-receiving channel of a single element reduction, and functions to capture the brush when it reaches the end of its travel.

In both embodiments, the protective device includes end abutments 45 which engage tube terminus 30, and in the embodiment of FIG. 6 also engage tube sheet 6.

Furthermore, and in the embodiments of FIGS. 4, 5 and 6, inserts 30 are substantially longer than the thickness of tube sheet 6. In addition, in the embodiments of FIGS. 5 and 6, inserts 30 are also substantially longer than the length of brush capturing basket 37.

The various aspects of the invention provide a solution to long-standing problems created by heat exchanger tube corrosion as well as erosion of the interior tube wall for a finite distance inwardly of the tube end. The difficulties encountered with prior attempts to solve the problems having been essentially eliminated by a simple yet unique expedient. The connecting of brush-capturing baskets to the inserts is also accomplished in a simple but unique fashion, and when the elements are fully integral they provide a multi-function combination that is less costly to produce and easily replaceable if necessary.

Various modes of carrying out the invention are contemplated as being within the scope of the following claims particularly pointing out and distinctly claiming the subject matter which is regarded as the invention.

We claim

1. In a heat exchanger, the combination comprising:

(a) a housing (2), (b) a plurality of metallic fluid flow tubes (5) disposed in general parallelism within said housing and with said tubes being arranged with exposed open end portions communicating with a housing chamber (8, 10, 11), (c) the inner surfaces of said metallic tubes being subjected, for a finite distance (21) inwardly from the outer terminus (31) thereof, to visually observable erosion (19) caused by fluid turbulence (17, 18), and with the inner surfaces of said tubes inwardly of said finite distance being relatively free of said turbulence and erosion due to laminar fluid flow, said inner tube surfaces being also subjected to corrosion by the fluid flowing therewithin, (d) and a non-metallic sleeve-like insert (30) mounted in telescoping engagement within the outer end portion of at least some of said tubes, (e) said non-metallic inserts being elongated and extending axially inwardly within their resepctive tubes for at least said finite distance (21) and thereby forming means to protect said inner tube surfaces against said corrosion and said turbulence-caused erosion throughout said finite distance, (f) and a heat exchanger tube cleaning system comprising:

(1) a plurality of tube cleaning elements (42) shuttleable within said tubes and with said elements having an O.D. approximating the I.D. of said inserts (30), (2) and a tube cleaning element capturing device (37) connected to the outer end of the respective inserts (30) and disposed in a respective said chamber, (3) said devices being of similar material as said inserts, (g) said inserts (30) providing a single element which is of substantially constant inner diameter between its ends, and wherein said finite distance (21) subject to turbulence-caused erosion and the length of said elongated inserts (30) and in the range of about 5 to 12 inches as determined by the I.D. of said heat exchanger tubes (5) and the velocity, pressure and composition of the flowing fluid.

2. The heat exchanger of claim 1 wherein:

(a) said inserts (30) include a portion extending axially outwardly beyond the respective tube terminus portions (31), (b) and said tube cleaning element capturing devices (37) are threadably connected (36, 41) to said axially outwardly extending insert portions.

3. The heat exchanger of claim 1 wherein:

(a) said inserts (30) include a portion extending axially outwardly beyond the respective tube terminus portions (31), (b) and wherein said tube cleaning element capturing devices (37) are connected integrally to said axially outwardly extending insert portions.

4. The heat exchanger of claim 1 wherein said inserts (30) are substantially longer than said tube cleaning element capturing devices (37).

5. The heat exchanger of claim 1:

(a) which includes transverse tube sheets (6, 7) disposed within said housing (2) and forming means mounting said tubes (5) closely adjacent said outer tube terminus portions (31), (b) and wherein said inserts (30) are substantially longer than the thickness of said tube sheets (6, 7).

6. The heat exchanger of claim 4:

(a) which includes transverse tube sheets (6, 7) disposed within said housing (2) and forming means mounting said tubes (5) closely adjacent said outer tube terminus portions (31), (b) and wherein said inserts (30) are substantially longer than the thickness of said tube sheets (6, 7).

7. The heat exchanger of claim 1 which includes means (33) for filling any voids occurring between a heat exchanger tube (5) and a said insert (30) disposed therewithin.

* * * * *